US009541889B2

(12) United States Patent
Matsumoto

(10) Patent No.: US 9,541,889 B2
(45) Date of Patent: Jan. 10, 2017

(54) IMAGE FORMING APPARATUS AND IMAGE FORMING METHOD

(71) Applicant: FUJI XEROX CO., LTD., Tokyo (JP)

(72) Inventor: Yasutaka Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/857,170

(22) Filed: Sep. 17, 2015

(65) Prior Publication Data

US 2016/0282801 A1 Sep. 29, 2016

(30) Foreign Application Priority Data

Mar. 25, 2015 (JP) ..... 2015-062370

(51) Int. Cl.
*G03G 21/00* (2006.01)
*G03G 15/08* (2006.01)
*G03G 15/02* (2006.01)

(52) U.S. Cl.
CPC ..... *G03G 21/0094* (2013.01); *G03G 15/0266* (2013.01); *G03G 15/0822* (2013.01); *G03G 2221/0036* (2013.01)

(58) Field of Classification Search
CPC ..... G03G 15/0266; G03G 15/0822; G03G 21/0094; G03G 2221/0036
USPC ..... 399/27, 127
See application file for complete search history.

(56) References Cited

U.S. PATENT DOCUMENTS

2004/0047642 A1* 3/2004 Kosuge ..... G03G 15/081 399/53

FOREIGN PATENT DOCUMENTS

JP 2011-027884 A 2/2011

* cited by examiner

*Primary Examiner* — Benjamin Schmitt
(74) *Attorney, Agent, or Firm* — Sughrue Mion, PLLC

(57) ABSTRACT

An image forming apparatus includes a developing unit and a supply amount increasing unit. The developing unit supplies oil-impregnated particles to an image carrier and develops an electrostatic latent image by a developer on the image carrier which is electrically charged to a polarity that is opposite a polarity of the developer which is electrically charged to a positive polarity or a negative polarity, based on a potential difference between a developing part and the image carrier. The supply amount increasing unit increases an amount of supply of the oil-impregnated particles to the image carrier by adjusting the potential of the image carrier, while a developing operation is not being performed by the developing unit.

6 Claims, 8 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2015-062370 filed Mar. 25, 2015.

BACKGROUND (i) Technical Field

The present invention relates to an image forming apparatus and an image forming method.

(ii) Related Art

By supplying developer to which oil-impregnated particles are added, wearing of a cleaning blade is reduced compared to the case where no oil-impregnated particles are supplied.

Developer and oil-impregnated particles are electrically charged to polarities opposite to each other. In the case where an image has a low density, oil-impregnated particles are supplied along with toner development to an image carrier. In contrast, in the case where an image has a high density, the amount of supply of oil-impregnated particles is small, and it is difficult to positively supply oil-impregnated particles.

SUMMARY

According to an aspect of the invention, there is provided an image forming apparatus including a developing unit and a supply amount increasing unit. The developing unit supplies oil-impregnated particles to an image carrier and develops an electrostatic latent image by a developer on the image carrier which is electrically charged to a polarity that is opposite a polarity of the developer which is electrically charged to a positive polarity or a negative polarity, based on a potential difference between a developing part and the image carrier. The supply amount increasing unit increases an amount of supply of the oil-impregnated particles to the image carrier by adjusting the potential of the image carrier, while a developing operation is not being performed by the developing unit.

BRIEF DESCRIPTION OF THE DRAWINGS

Exemplary embodiment of the present invention will be described in detail based on the following figures, wherein.

DETAILED DESCRIPTION

Figure 1:
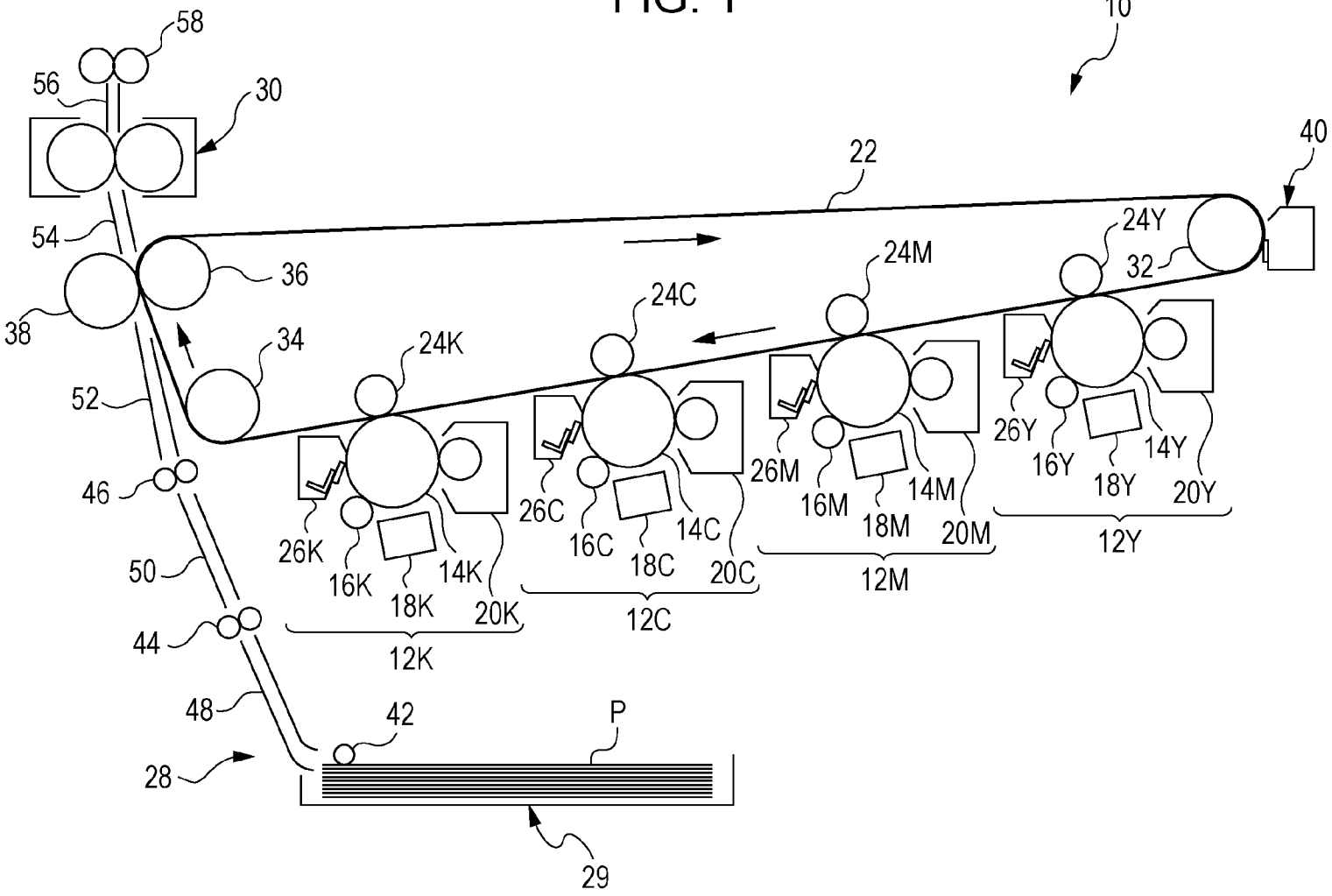
FIG. 1 is a schematic diagram illustrating a configuration of an image forming apparatus according to an exemplary embodiment in front view.

FIG. 1 is a schematic configuration diagram of an image forming apparatus 10 according to an exemplary embodiment.

The image forming apparatus 10 is able to perform full-color image formation of a quadruple tandem type. In the image forming apparatus 10, a first image forming unit 12Y, a second image forming unit 12M, a third image forming unit 12C, and a fourth image forming unit 12K of an electrophotographic system which output images in yellow (Y), magenta (M), cyan (C), and black (K), respectively, are arranged in order from the upstream side with predetermined spaces therebetween.

In the description provided below, since the four image forming units: the first image forming unit 12Y, the second image forming unit 12M, the third image forming unit 12C, and the fourth image forming unit 12K, have the same configuration, they are generically referred to as "image forming units 12". When the image forming units 12 are explained without component members of the individual image forming units 12 being distinguished from one another, the ending of a sign of each component member ("Y", "M", "C", and "K") may be omitted in FIG. 1.

Each of the image forming units 12 includes a photoconductor drum 14 of a drum shape as an image carrier which includes a photoconductor layer on the surface thereof, a charging device 16 that electrically charges the photoconductor drum 14 in a uniform manner, an exposing device 18 that irradiates the uniformly charged photoconductor drum 14 with image light to form an electrostatic latent image, a developing device 20 that transfers toner to the latent image to form a toner image, and a cleaning device 26 that removes toner remaining on the photoconductor drum 14 after transfer is performed.

The image forming apparatus 10 also includes an intermediate transfer belt 22 of an endless belt shape which stretches so as to rotate along a path which is in contact with the photoconductor drum 14 of each of the four image forming units 12, and first transfer rolls 24 that transfer toner images formed on the photoconductor drums 14 to the intermediate transfer belt 22.

The image forming apparatus 10 also includes a recording paper conveyance mechanism 28 that conveys recording paper P accommodated within a paper tray 29, and a fixing device 30 that fixes a toner image on the recording paper P.

The intermediate transfer belt 22 is wound around the first transfer rolls 24, a drive roll 32 that is driven to rotate, a tension roll 34 that adjusts tension, and a backup roll 36.

At a position which faces the backup roll 36 through the intermediate transfer belt 22, a second transfer roll 38 that transfers a toner image on the intermediate transfer belt 22 to the recording paper P that is conveyed by the recording paper conveyance mechanism 28, is provided. Furthermore, the image forming apparatus 10 also includes a toner removal device 40 that removes toner remaining on the intermediate transfer belt 22 after a toner image is transferred to the recording paper P by the second transfer roll 38.

The recording paper conveyance mechanism 28 is formed of a pickup roll 42, conveyance rolls 44 and 46, paper guides 48, 50, 52, 54, and 56 that provide guidance of the conveyance movement routes, a paper exit roll 58, a paper exit tray (not illustrated in FIG. 1), and the like. The recording paper conveyance mechanism 28 is driven to convey the recording paper P which is accommodated in a paper tray 29 to a second transfer position at which the second transfer roll 38 and the backup roll 36 face each other with the intermediate transfer belt 22 therebetween. Then, the recording paper conveyance mechanism 28 is driven to convey the recording paper P from the second transfer position to the fixing device 30, and is then driven to convey the recording paper P from the fixing device 30 to the paper exit tray.

Figure 2:
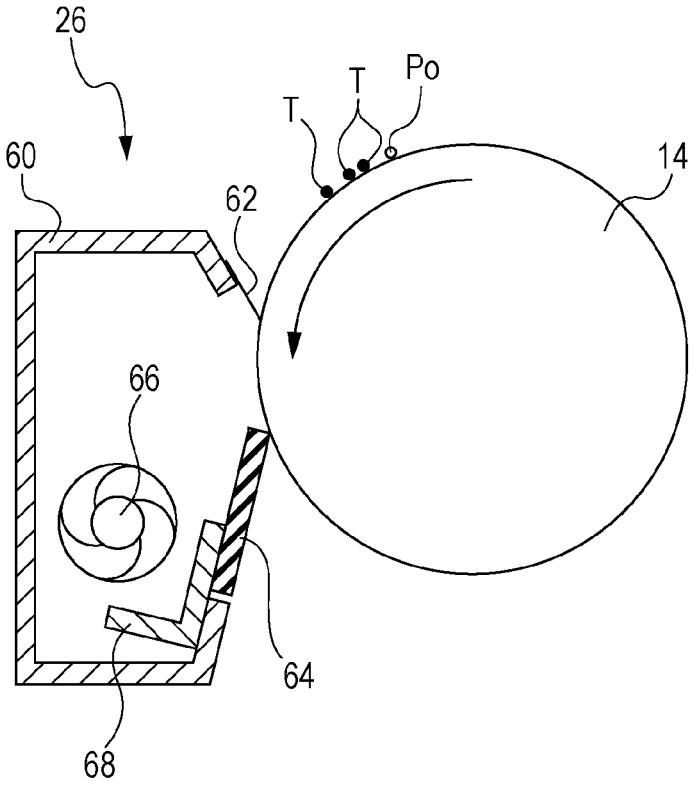
FIG. 2 is an enlarged diagram of a cleaning device according to the exemplary embodiment.

FIG. 2 is a sectional view illustrating a detailed configuration of the cleaning device 26 which faces the circumferential surface of the photoconductor drum 14.

The cleaning device 26 is arranged in close proximity to the photoconductor drum 14, and includes a cleaner housing 60 that has an opening on a side facing the photoconductor drum 14. One end portion of a seal member 62 is fixed at an end portion of the opening on the upper side of the cleaner housing 60.

The other end portion of the seal member 62 is in contact with the photoconductor drum 14 to substantially block the gap between the photoconductor drum 14 and the cleaner housing 60, thereby preventing waste toner T accommodated within the cleaning device 26 from leaking or scattering to the outside. The seal member 62 is, for example, a thermoplastic polyurethane film with a thickness of 0.1 mm.

Inside the cleaner housing 60, a cleaning blade 64 as a cleaning member is arranged at a position on the downstream side in the rotational direction (indicated by an arrow in FIG. 2) of the photoconductor drum 14 with respect to the seal member 62. Furthermore, an auger 66 is provided at a lower part in the cleaner housing 60.

The cleaning blade 64 is made of an elastic material and is formed in a plate shape with a predetermined thickness. As a blade material, for example, thermosetting polyurethane rubber, which is excellent in mechanical properties, such as wearing resistance, chipping resistance, and creep resistance, is used.

The material of the cleaning blade 64 is not limited to urethane rubber. Functional rubber materials, such as silicone rubber, fluororubber, and ethylene propylene diene rubber, may be used. Furthermore, the cleaning blade 64 is adhered to a sheet metal 68 and is provided such that a leading edge portion of the cleaning blade 64 is made in contact with the surface of the photoconductor drum 14.

A blade pressurization method in this exemplary embodiment adopts a low-cost constant displacement method with a simple structure. However, the blade pressurization method is not limited to the constant displacement method. A constant load method in which there is a negligible amount of change with time in the contact pressure may be used.

In the cleaning device 26 with the above configuration, toner which is not transferred and remains on the surface of the photoconductor drum 14 (transfer residual toner T) directly passes in front of the seal member 62, and is then scraped by the cleaning blade 64.

The toner scraped by the cleaning blade 64 is temporarily housed in the cleaner housing 60, and is eventually conveyed and discharged sideways and out of the cleaning device 26 by the auger 66.

The cleaning device 26 is configured as a unit (process cartridge) which is integrated with at least the photoconductor drum 14, and may be attached and removed to and from the image forming apparatus in the state of unit.

Engine Part Control System

Figure 3:
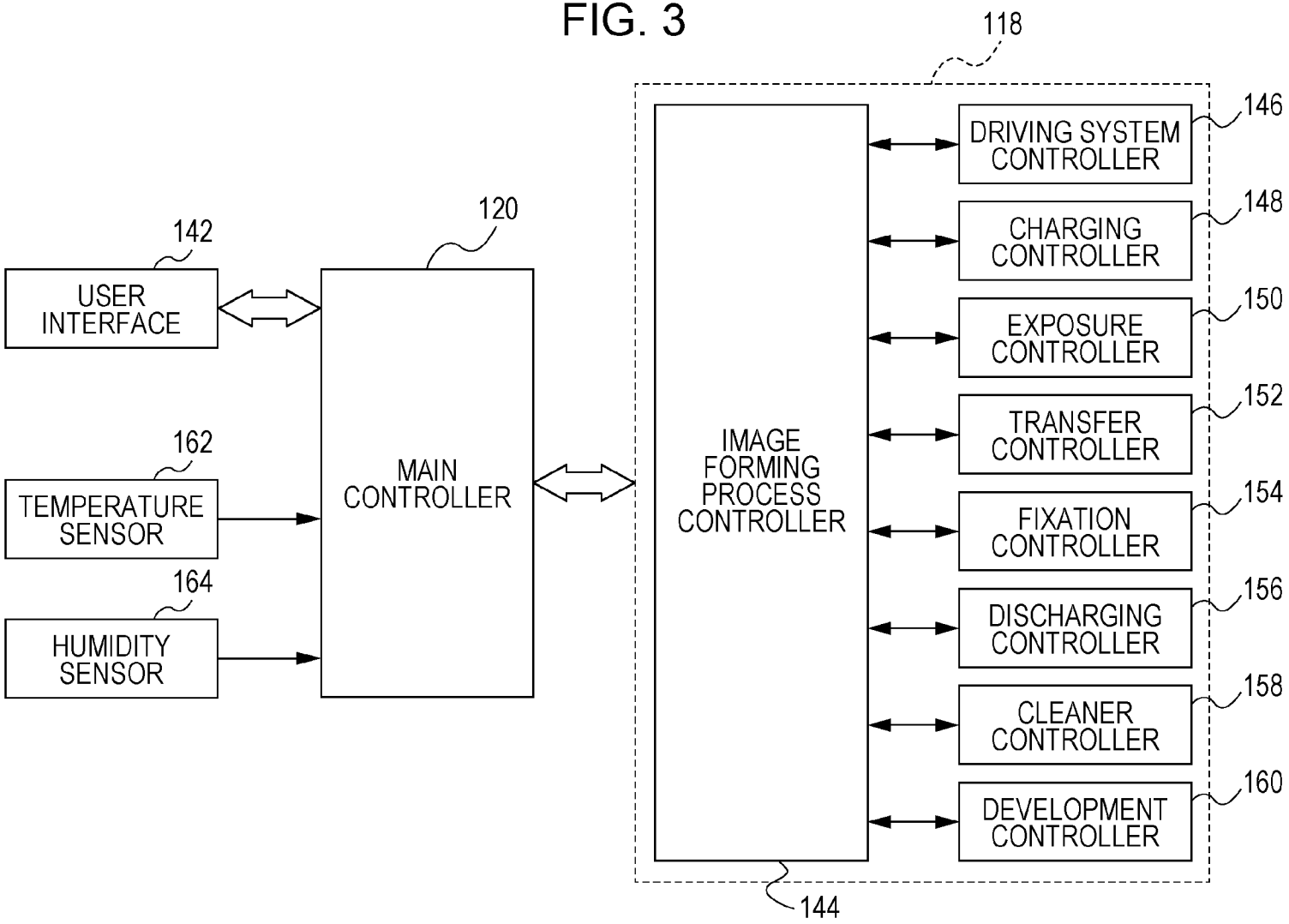
FIG. 3 is a control block diagram of an image forming process engine according to the exemplary embodiment.

FIG. 3 is a block diagram illustrating an example of a control system of the image forming apparatus 10.

A user interface 142 is connected to a main controller 120. An instruction regarding image formation or the like is issued in accordance with a user operation, and the user is informed of information at the time of image formation or the like.

A network line with an external host computer, which is not illustrated in FIG. 3, is connected to the main controller 120. Image data is input to the main controller 120 via the network line.

When image data is input, for example, the main controller 120 analyzes print instruction information included in the image data and the image data, converts the image data into a format (for example, bitmap data) which fits the image forming apparatus 10, and outputs the converted image data to an image forming process controller 144, which functions as a part of an MCU 118.

The image forming process controller 144 performs, based on the received image data, synchronous control of a driving system controller 146, a charging controller 148, an exposure controller 150, a transfer controller 152, a fixation controller 154, a discharging controller 156, a cleaner controller 158, and a development controller 160, each of which functions as the MCU 118 in cooperation with the image forming process controller 144, and performs image formation. In this exemplary embodiment, the function executed by the MCU 118 is divided into blocks and described as functional blocks. The description in this exemplary embodiment does not limit the hardware configuration of the MCU 118.

A temperature sensor 162, a humidity sensor 164, and the like are connected to the main controller 120. Based on the temperature sensor 162 and the humidity sensor 164, the ambient temperature and humidity inside the housing of the image forming apparatus 10 may be detected.

Toner Additives

In order to perform cleaning with the cleaning blade 64, it is effective to supply oil. Thus, oil-impregnated elastomer particles Po (see FIG. 2) as oil-impregnated particles are added to toner.

The oil-impregnated elastomer particles Po are not particularly limited as long as they have a structure to contain oil. Particles having a cross-linked structure, having a porous body, and the like may be used as the oil-impregnated elastomer particles Po.

Oil contained in the oil-impregnated elastomer particles Po may be a compound with a melting point of less than 20 degrees Centigrade, that is, a compound in the form of liquid at 20 degrees Centigrade, and known various types of silicone oil and lubricating oil are example of the oil contained in the oil-impregnated elastomer particles Po. Furthermore, only one type of oil or two or more types of oil may be contained in the oil-impregnated elastomer particles Po.

It is desirable that oil in which the oil-impregnated elastomer particles Po are impregnated is silicone oil. Silicone oil such as dimethyl polysiloxane, diphenyl polysiloxane, and phenyl methylpolysiloxane, reactive silicone oil such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane, and the like are examples of silicone oil.

Among the above types of silicone oil, dimethyl polysiloxane (may also be referred to as "dimethyl silicone oil") is particularly preferable for the reason that, for example, an externally added dam is formed evenly and uniformly in the width direction of a cleaning blade, a secondary failure caused by contamination does not occur in another process, and the like.

A preparation example of the oil-impregnated elastomer particles Po will be described below.

Mixture dissolution of 40 parts of styrene, 10 parts of butadiene, 25 parts of diethylbenzene and 50 parts of isoamyl alcohol as diluent, and 2.0 parts of dimethyl 2,2'-azobis (2-methylbutyronitrile) as polymerization initiator is performed.

The resultant mixture is poured into a dispersion solution of 10 parts of calcium carbonate powder (number average particle diameter: 0.1 μm, "TP-123" by Okutama Kogyo Co., Ltd.), 50 parts of sodium chloride, and 200 parts of water. After execution of emulsification by a mixer at 6,000 rpm for one minute, polymerization reaction is carried out in a nitrogen atmosphere at 70 degrees Centigrade for 20 hours.

Then, after pouring hydrochloric acid to dissolve calcium carbonate, water washing is performed. Next, in order to remove the diluent, ethanol washing is performed. Furthermore, elastomer particles with a number average particle diameter of 3 μm are selected by wet classification, and vacuum drying is carried out at 100 degrees Centigrade for 12 hours.

Then, after 150 parts of dimethyl silicone coil ("KM 351" by Shin-Etsu Chemical Co., Ltd., viscosity of 50 centistokes at 25 degrees Centigrade) is dissolved in 1,000 parts of ethanol and stirring and mixing with 100 parts of elastomer particles is performed, solvent ethanol is removed and dried by using an evaporator, and oil-impregnated elastomer 1 is obtained. The obtained oil-impregnated elastomer has a number average particle diameter of 3 μm and a spheroidicity of 0.95.

Developing Step

The charging device 16 electrically charges the surface of the photoconductor drum 14Y to a potential of −820 V. In general, the potential may be selected within the range from −500 V to −820 V.

Light beams for exposure are applied by the exposing device 18 to the photosensitive layer of the surface of the electrically charged photoconductor drum 14Y.

Figure 4A:
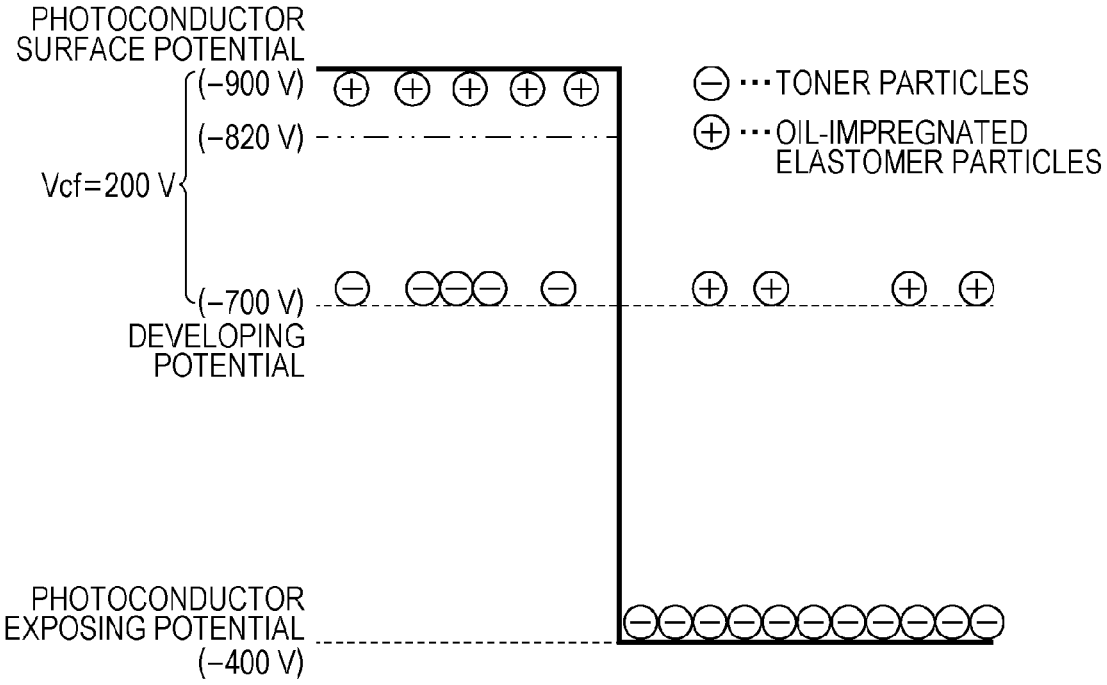
FIG. 4A is a characteristic chart illustrating a transfer state of particles based on the potential of a surface of a photoconductor drum in a normal image forming process mode.
Figure 4B:
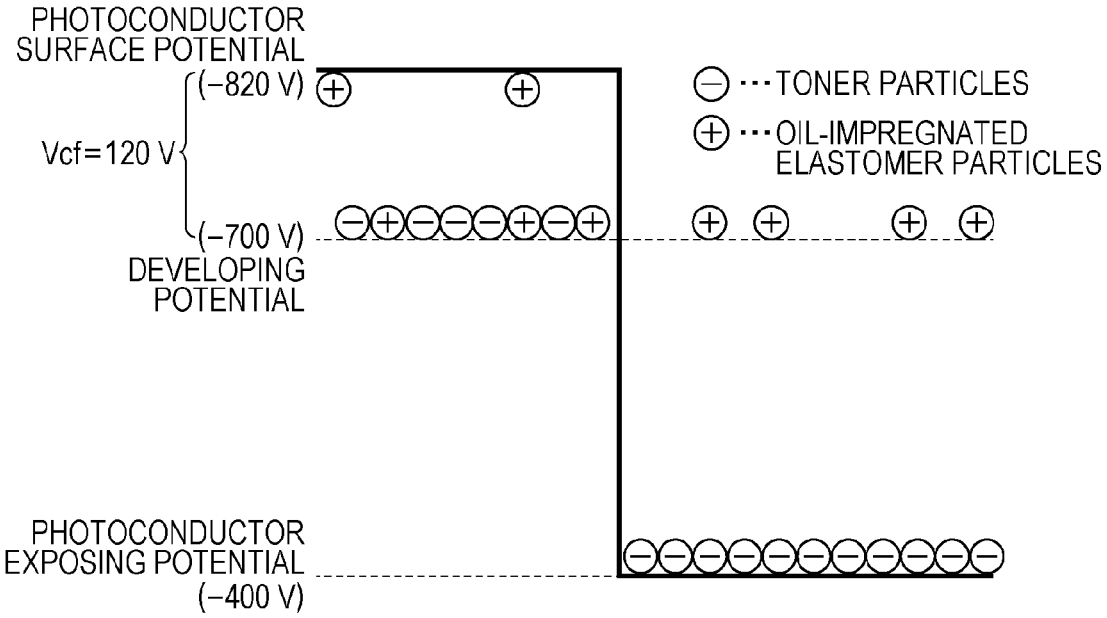
FIG. 4B is a characteristic chart illustrating a transfer state of particles based on the potential of a surface of a photoconductor drum in a calibration mode.

At this time, as illustrated in FIG. 4B, regarding the surface of the photoconductor drum 14, the surface potential in a region irradiated with the light beams is −400 V, and a potential difference occurs with respect to the surface potential (−820 V) at the time when being electrically charged by the charging device 16.

The electrostatic latent image formed on the photoconductor drum 14Y is sent to a development position by the rotation of the photoconductor drum 14Y, and the electrostatic latent image is developed into a visible image (toner image) by the developing device 20.

That is, inside the developing device 20, toner is stirred and frictionally charged, electric charges on the toner have the same polarity (−) as the electric charges on the surface of the photoconductor drum 14Y, and the developing potential is −700 V.

Therefore, while the surface of the photoconductor drum 14 passes through the developing device 20, toner is electrostatically adhered to an electrostatic latent image region of the surface of the photoconductor drum 14 (the surface potential of the electrostatic latent image region of the photoconductor drum, which is on the positive side with respect to the developing potential, is −400 V), and the electrostatic latent image is developed by the toner.

Supply Control of Oil-Impregnated Particles

Here, the oil-impregnated elastomer particles Po added to toner are electrically charged to the polarity (in this case, positive "+") opposite the polarity (in this case, negative "−") of the toner. In other words, the oil-impregnated elastomer particles Po are supplied to a non-electrostatic latent image region on the surface of the photoconductor drum 14 in which light beams are not applied at the time of development and the surface potential is maintained at −820 V.

Thus, in the case of a general image (a character image or a photographic image), a non-electrostatic latent image region exists in a part of an image formation region, and a necessary and sufficient amount of toner-impregnated elastomer particles may be supplied (transferred) to the photoconductor drum 14. The oil-impregnated elastomer particles Po may be supplied to an electrostatic latent image region, along with the transfer of toner.

For example, if character images and photographic images coexist at an appropriate ratio, there may be no problem. However, in an image forming process, for example, if there are consecutive photographic images or so-called solid images such as chart images, a sufficient area of a non-electrostatic latent image region is not obtained, and supply of the oil-impregnated elastomer particles Po to the photoconductor drum 14 is thus not sufficient.

Thus, in this exemplary embodiment, the MCU 118 additionally sets an oil-impregnated elastomer particle amount correction mode (calibration mode (see FIG. 4A)), separately from a normal image forming process mode (see FIG. 4B), and performs control for forcibly supplying the oil-impregnated elastomer particles Po to the photoconductor drum 14.

The calibration mode utilizes the state in which oil-impregnated elastomer particles are electrically charged to the polarity (+) opposite the polarity (−) of toner.

That is, as illustrated in FIG. 4A, in the calibration mode, the potential at which the photoconductor drum 14 is electrically charged by the charging device 16 is changed from −820 V for the image forming mode to −900 V. Here, −900 V is the potential dedicated to the calibration mode.

By setting the surface potential of the photoconductor drum 14 to −900 V, the potential difference Vcf from the developing part potential (−700 V) increases. Thus, the oil-impregnated elastomer particles Po which are positively charged are easily transferred, and the amount of supply of the oil-impregnated elastomer particles Po from the developing device 20 to the photoconductor drum 14 increases compared to the case where the surface potential of the photoconductor drum 14 is −820 V.

Figure 5:
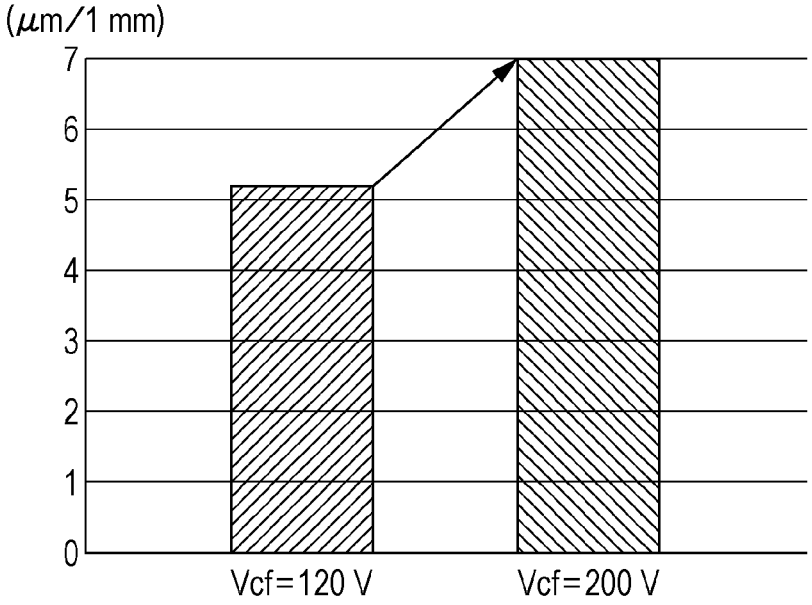
FIG. 5 is a characteristic chart of the amount of supply of oil-impregnated elastomer particles in the normal image forming process mode and the calibration mode.

FIG. 5 is a characteristic chart illustrating the amount of supply (for example, μm/mm) of the oil-impregnated elastomer particles Po per unit area for the potential difference Vcf (120 V) between the surface potential (−820 V) and the developing potential of the photoconductor drum 14 in the image forming mode and for the potential difference Vcf (200 V) between the surface potential (−900 V) and the developing potential of the photoconductor drum 14 in the calibration mode.

As illustrated in FIG. 5, as the potential difference Vcf between the surface potential and the developing part potential of the photoconductor drum 14 increases, the amount of supply of the oil-impregnated elastomer particles Po increases.

In both the image forming process mode illustrated in FIG. 4B and the calibration mode illustrated in FIG. 4A, the transfer residual toner T is not transferred, irrespective of the potential difference Vcf between the surface potential and the developing part potential of the photoconductor drum 14. In contrast, the oil-impregnated elastomer particles Po are transferred more easily as the potential difference Vcf between the surface potential and the developing part potential of the photoconductor drum 14 increases.

It is known that, when the potential difference Vcf exceeds 160 V, bead-carry-out (BCO), that is, an image quality defect, such as white void, caused by transfer of carriers that attract toner at the developing device 20 to the photoconductor drum 14, occurs.

In this exemplary embodiment, an image forming process is performed by setting the surface potential of the photoconductor drum 14 to −820 V (Vcf=120 V) in the image forming mode, and an operation equivalent to the image forming process is performed in the calibration mode by setting the surface potential of the photoconductor drum 14 to −900 V (Vcf=200 V).

Figure 6:
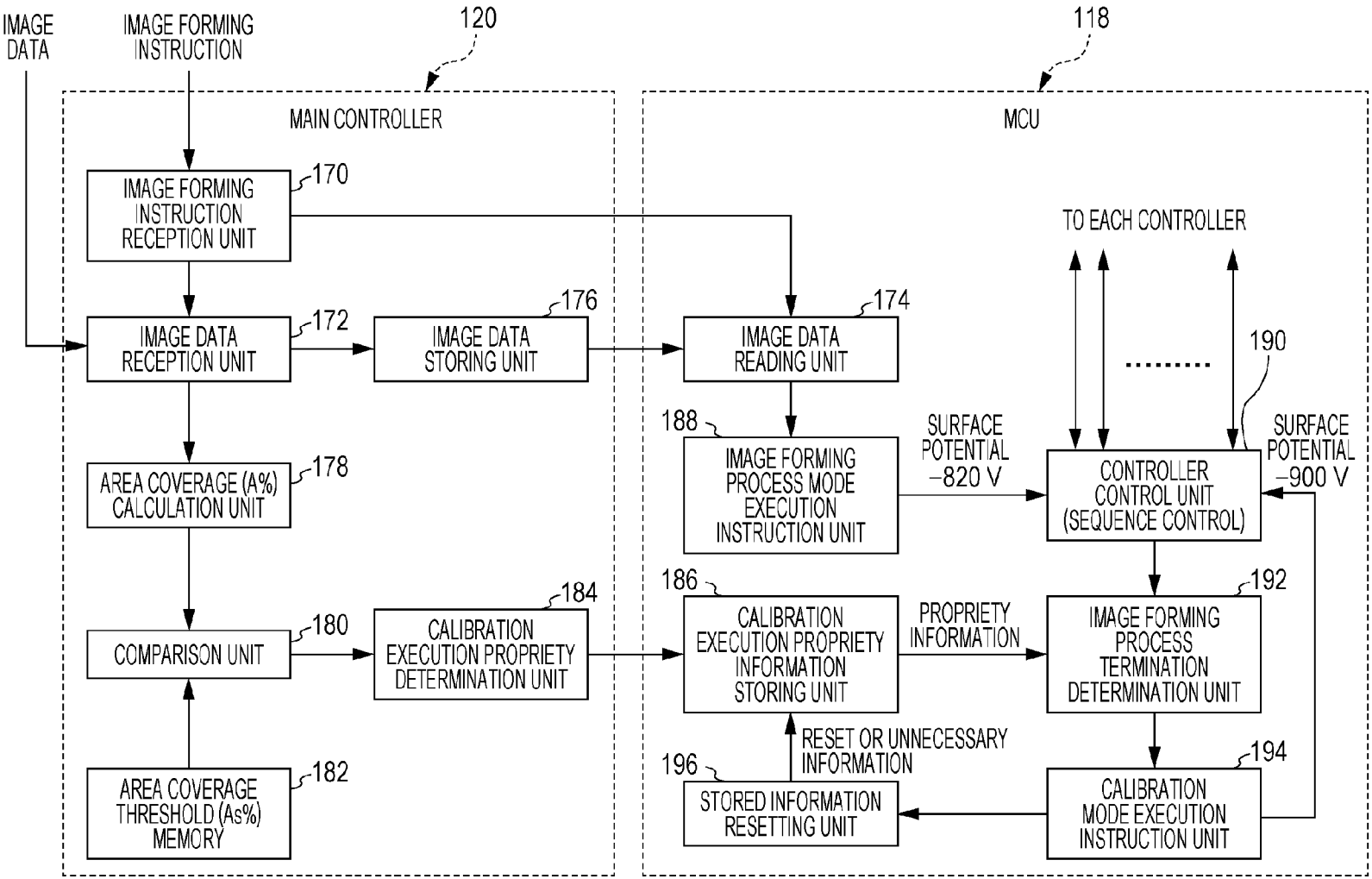
FIG. 6 illustrates an example of a functional block diagram for performing a calibration mode propriety determination and an image forming process that are performed in cooperation between a main controller and an MCU.

FIG. 6 illustrates an example of a functional block diagram for performing a calibration mode propriety determination and an image forming process that are performed in cooperation between the main controller 120 and the MCU 118 illustrated in FIG. 3. The functional block diagram of FIG. 6 does not limit the hardware configuration of the main controller 120 and the MCU 118. The functions of the main controller 120 and the MCU 118 are not limited to those illustrated in FIG. 6 as long as the calibration mode propriety determination and the image forming process may be implemented.

An image forming instruction reception unit 170 of the main controller 120 receives an image forming instruction which includes, for example, an operation on a start key of the user interface 142 or a print instruction from a communication network.

The image forming instruction reception unit 170 is connected to an image data reception unit 172. When receiving an image forming instruction, the image forming instruction reception unit 170 outputs an instruction for receiving image data to the image data reception unit 172, and outputs an execution instruction to an image data reading unit 174 of the MCU 118.

The image data reception unit 172 receives image data read from the outside or an image reading device, and stores the received image data into an image data storing unit 176.

The image data reception unit 172 is connected to an area coverage calculation unit 178. The area coverage calculation unit 178 calculates the area coverage of the received image data, that is, the proportion (%) of the toner consumption for one piece of recording paper P.

In general, for example, the area coverage of a character image is 1% to 5%, and the area coverage of a photographic image is 60% to 70%. Furthermore, the area coverage of a so-called solid image (including a chart image) may be a value close to 100%.

The area coverage calculation unit 178 is connected to a comparison unit 180, and outputs the calculated area coverage (A %) to the comparison unit 180.

An area coverage threshold memory 182 is connected to the comparison unit 180. The area coverage threshold memory 182 stores a threshold (As %) for determining whether or not to execute the calibration mode.

When receiving the calculated area coverage (A %), the comparison unit 180 reads the threshold (As %) from the area coverage threshold memory 182, and compares the area coverage with the threshold (A %:As %).

A calibration execution propriety determination unit 184 is connected to the comparison unit 180. A comparison result obtained by the comparison unit 180 is output to the calibration execution propriety determination unit 184.

When it is determined that A % is greater than As %, the calibration execution propriety determination unit 184 outputs information (necessary information) which indicates that it is necessary to execute the calibration mode to a calibration execution propriety information storing unit 186 of the MCU 118.

When it is determined that A % is smaller than or equal to As %, the calibration execution propriety determination unit 184 outputs information (unnecessary information) which indicates that it is unnecessary to execute the calibration mode to the calibration execution propriety information storing unit 186 of the MCU 118.

Meanwhile, the image data reading unit 174 of the MCU 118 reads image data from the image data storing unit 176 of the main controller 120, and outputs the read image data to an image forming process mode execution instruction unit 188.

The image forming process mode execution instruction unit 188 instructs a controller control unit 190 to control operations of the individual controllers illustrated in FIG. 3, in accordance with a control program which executes the normal image forming process mode. The individual controllers illustrated in FIG. 3 are the driving system controller 146, the charging controller 148, the exposure controller 150, the transfer controller 152, the fixation controller 154, the discharging controller 156, the cleaner controller 158, and the development controller 160.

The controller control unit 190 performs an image forming process by controlling the operations of the individual controllers, based on sequence control for the individual controllers. In the normal image forming process mode, the controller control unit 190 instructs the charging controller 148 to perform electric charging so that the surface potential of the photoconductor drum 14 becomes −820 V.

Furthermore, the controller control unit 190 is connected to an image forming process termination determination unit 192. The image forming process termination determination unit 192 monitors the image forming process control based on the controller control unit 190, and determines whether or not the image forming process has ended.

When confirming that the image forming process has ended, the image forming process termination determination unit 192 obtains from the calibration execution propriety information storing unit 186 propriety information which indicates whether or not the calibration mode is to be executed, and outputs the obtained propriety information to a calibration mode execution instruction unit 194.

In the case where the calibration mode needs to be executed, based on the propriety information, the calibration mode execution instruction unit 194 instructs the controller control unit 190 to perform an operation equivalent to an image forming operation. At this time, the controller control unit 190 instructs the charging controller 148 to perform electric charging so that the surface potential of the photoconductor drum 14 becomes −900 V, as the calibration mode.

Furthermore, the calibration mode execution instruction unit 194 is connected to a stored information resetting unit 196. At a point in time when a calibration execution instruction is received, the stored information resetting unit 196 resets the propriety information stored in the calibration execution propriety information storing unit 186. When the propriety information includes a flag "1" or "0", the reset instruction may indicate a flag state representing unnecessary information.

Working of this exemplary embodiment will be described below.

Flow of Normal Image Forming Process Mode

Since the image forming units 12 have substantially the same configuration, the first image forming unit 12Y which is arranged on the upstream side in the travelling direction of the intermediate transfer belt 22 and forms a yellow image will be explained below, on behalf of the image forming units 12. By assigning the same reference sign with magenta (M), cyan (C), and black (K), in place of yellow (Y), to the members having the same function as the first image forming unit 12Y, explanation for the second, third, and fourth image forming units 12M, 12C, and 12K will be omitted.

In this exemplary embodiment, prior to an operation, the surface of the photoconductor drum 14Y is electrically charged to a potential of −800 V by the charging device 16Y. In general, the potential may be selected within a range from −600 V to −800 V.

The photoconductor drum 14Y is formed by stacking a photosensitive layer on a conductive substrate made of metal, and has a high resistance in a normal state. When LED beams are applied to the photoconductor drum 14Y, the specific resistance of a part irradiated with the LED beams changes.

With the MCU 118, light beams for exposure (for example, LED beams) are output by the exposing device 18 to the surface of the electrically charged photoconductor drum 14Y, in accordance with image data for yellow transmitted from the main controller 120. The light beams are applied to the photosensitive layer of the surface of the photoconductor drum 14Y, thereby an electrostatic latent image of a yellow printing pattern being formed on the surface of the photoconductor drum 14Y.

An electrostatic latent image is an image formed on the surface of the photoconductor drum 14Y by electric charging, and a so-called negative latent image which is formed by causing the specific resistance of an irradiated part of the photosensitive layer to be reduced by the light beams, causing electric charges on the surface of the photoconductor drum 14Y to flow, and causing electric charges on a part which is not irradiated with light beams to remain.

The electrostatic latent image formed on the photoconductor drum 14Y as described above is rotated to a predetermined development position by the rotation of the photoconductor drum 14Y. Then, the electrostatic latent image on the photoconductor drum 14Y is developed at the development position into a visible image (toner image) by the developing device 20Y.

Yellow toner produced by an emulsion polymerization method is accommodated within the developing device 20Y. Yellow toner is frictionally charged by being stirred inside the developing device 20Y, and has electric charges of a same polarity (−) as the electric charges on the surface of the photoconductor drum 14Y.

While the surface of the photoconductor drum 14Y passes through the developing device 20Y, the yellow toner electrostatically adhered only to a discharged latent image part on the surface of the photoconductor drum 14Y, and the latent image is developed with the yellow toner.

The photoconductor drum 14Y continues to rotate, and the toner image developed on the surface of the photoconductor drum 14Y is conveyed to a predetermined first transfer position. When the yellow toner image on the surface of the photoconductor drum 14Y is conveyed to the first transfer position, a predetermined first transfer bias is applied to the first transfer roll 24Y. Thus, electrostatic force directing from the photoconductor drum 14Y to the first transfer roll 24Y operates on the toner image, and the toner image on the surface of the photoconductor drum 14Y is transferred to the surface of the intermediate transfer belt 22.

The transfer bias applied at this time has the polarity (+) opposite the polarity (−) of the toner, and in the first image forming unit 12Y, for example, constant current control to about +20 μA to about +30 μA is performed by the transfer controller 152.

Meanwhile, the transfer residual toner on the surface of the photoconductor drum 14Y is cleaned by the cleaning device 26Y.

The first transfer bias applied to the first transfer rolls 24M, 24C, and 24K for the second, third, and fourth image forming units 12M, 12C, and 12K is controlled in a similar manner.

The intermediate transfer belt 22 to which the yellow toner image is transferred by the first image forming unit 12Y as described above is conveyed through the second, third, and fourth image forming units 12M, 12C, and 12K sequentially, and toner images of the individual colors are superimposed on each other in a similar manner to perform multiple transfer.

The intermediate transfer belt 22 to which multiple transfer of toner images of all the colors is performed by all the image forming units 12 is slid and conveyed in the direction of the arrows in FIG. 1, and reaches a second transfer part which is formed of the backup roll 36 which is in contact with the inner surface of the intermediate transfer belt 22 and the second transfer roll (transfer unit) 38 which is arranged on the image carrier face side of the intermediate transfer belt 22.

Meanwhile, the recording paper P is fed by a supply mechanism to a position between the second transfer roll 38 and the intermediate transfer belt 22 at a predetermined timing, and a predetermined second transfer bias is applied to the second transfer roll 38.

The transfer bias applied at this time has the polarity (+) opposite the polarity (−) of toner. The electrostatic force directing from the intermediate transfer belt 22 to the recording paper P operates on the toner image, and the toner image on the surface of the intermediate transfer belt 22 is transferred to the surface of the recording paper P.

After that, the recording paper P is sent to the fixing device 30, and the toner image is heated and pressurized. The superimposed color toner images are melted and are permanently fixed to the surface of the recording paper P. The recording paper P on which fixation of the color images is completed is conveyed to an exit unit. Then, the series of color image forming operation ends.

Here, in the cleaning device 26 according to this exemplary embodiment, the transfer residual toner T remaining on the surface of the photoconductor drum 14 directly passes in front of the seal member 62, and is then scraped by the cleaning blade 64.

The toner scraped by the cleaning blade 64 is temporarily housed in the cleaner housing 60, and is eventually conveyed and discharged sideways and out of the cleaning device 26 by the auger 66.

Since the cleaning blade 64 is in contact with the circumferential surface of the photoconductor drum 14, the cleaning blade 64 becomes worn out with time (may include wearing of the photoconductor drum 14). In order to reduce the degree of wearing, the oil-impregnated elastomer particles Po are added to toner.

Calibration Mode

For example, in the image forming process, if there are consecutive photographic images or so-called solid images such as chart images, supply of the oil-impregnated elastomer particles Po to the photoconductor drum 14 is not sufficient compared to the case where there are no consecutive images with a large area coverage.

Thus, in this exemplary embodiment, the MCU 118 additionally sets an oil-impregnated elastomer particle amount correction mode (calibration mode (see FIG. 4A)), separately from the normal image forming process mode (see FIG. 4B), and performs control for forcibly supplying the oil-impregnated elastomer particles Po to the photoconductor drum 14.

Figure 7:
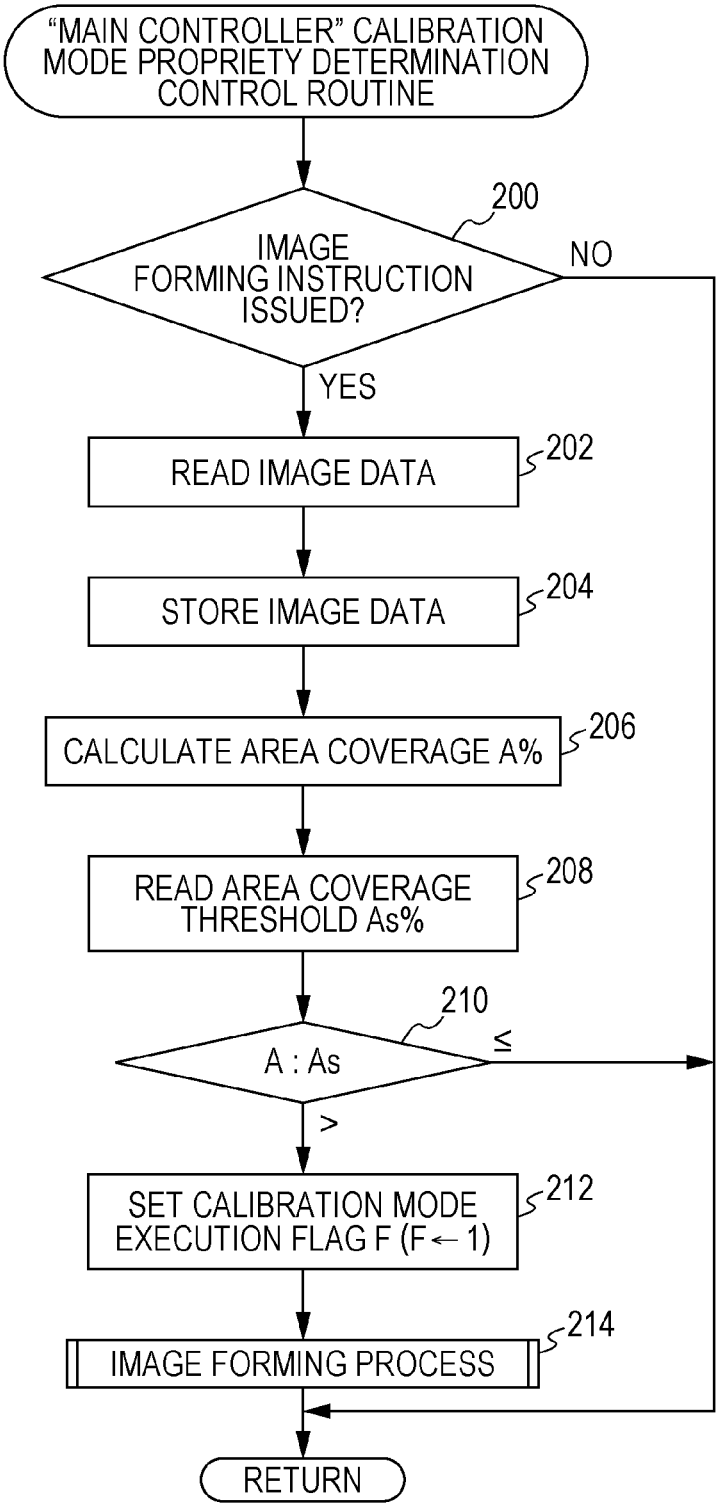
FIG. 7 is a flowchart illustrating a calibration propriety determination control routine executed at the main controller according to the exemplary embodiment.
Figure 8:
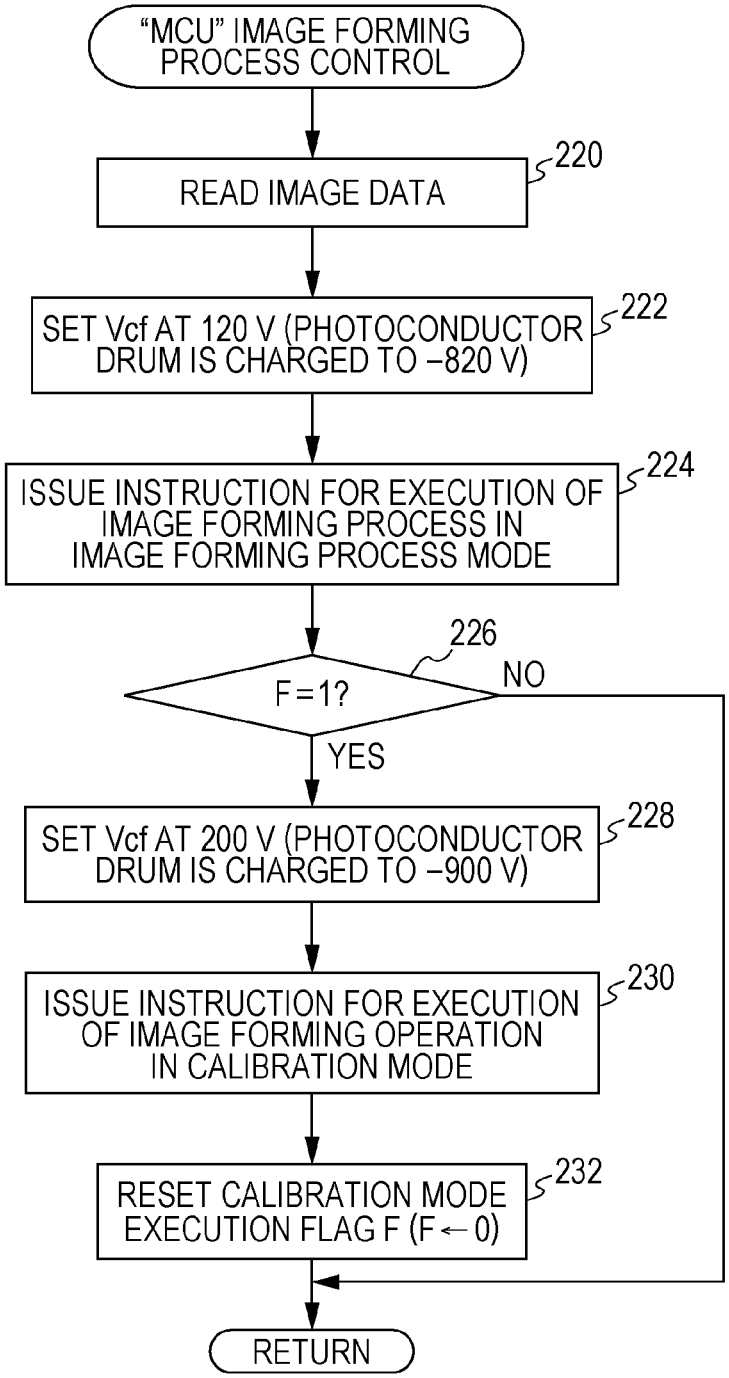
FIG. 8 is a flowchart illustrating an image forming process control routine executed at the MCU according to the exemplary embodiment.

FIGS. 7 and 8 are flowcharts illustrating flows of the calibration mode propriety determination and then image forming process that are performed in cooperation between the main controller 120 and the MCU 118.

Calibration Propriety Determination Control

FIG. 7 illustrates the calibration propriety determination control that is performed by the main controller 120. In step 200, it is determined whether or not an image forming instruction has been issued. When the determination result obtained in step 200 is negative, the routine ends.

When the determination result obtained in step 200 is affirmative, the routine proceeds to step 202. In step 202, image data is read. Then, in step 204, the read image data is stored.

Next, in step 206, the area coverage (A %) of the read image data is calculated. Then, in step 208, an area coverage threshold (As %) is read, and the routine proceeds to step 210.

In step 210, the calculated area coverage (A %) is compared with the threshold (As %).

When it is determined in step 210 that A is greater than As, it is determined that there is a possibility that the area coverage will cause a shortage of oil-impregnated elastomer particles Po, and the routine proceeds to step 212. In step 212, the calibration mode execution flag F is set (F←1), and the routine proceeds to step 214.

When it is determined in step 210 that A is smaller than or equal to As, it is determined that there is no possibility that the area coverage will cause a shortage of oil-impregnated elastomer particles Po, and the routine ends (F=0).

In step 214, under the control of the MCU 118, the image forming process is performed based on the read image data.

FIG. 8 is an image forming process control routine that is performed by the MCU 118. In step 220, stored image data is read. Then, in step 222, the charging controller 148 is instructed to perform electric charging so that the surface potential of the photoconductor drum 14 becomes −820 V (Vcf=120 V). Next, in step 224, under the normal image forming process mode, the individual controllers are instructed to execute the image forming process.

Then, in step 226, it is determined whether the calibration mode execution flag F is set (1) or not set (0).

When it is determined in step 226 that the flag F is in the reset state (0), it is determined that execution of the calibration mode is not necessary. Then, the routine ends.

When it is determined in step 226 that the flag F is in the set state (1), it is determined that execution of the calibration mode is necessary. Then, the routine proceeds to step 228.

In step 228, the charging controller 148 is instructed to perform electric charging so that the surface potential of the photoconductor drum 14 becomes −900 V (Vcf=200 V). Then, in step 230, under the calibration mode, the individual controllers are instructed to execute the image forming process.

In step 232, the calibration mode execution flag F is reset (0), and the routine ends.

In this exemplary embodiment, when an instruction for an image forming process is issued, the area coverage of image data is calculated. When a threshold is exceeded, the surface potential of the photoconductor drum 14 is changed from −820 V to −900 V, as the calibration mode. However, by utilizing a region of the photoconductor drum 14 other than the image formation region (for example, a joint part in the circumferential direction of the photoconductor drum 14), the amount of the oil-impregnated elastomer particles Po may be increased. That is, the photoconductor drum 14 is not uniformly charged, and the photoconductor drum 14 is electrically charged in such a manner that the potential differs between the image formation region and regions other than the image formation region. Accordingly, the developing operation and the processing for prompting and supplying oil-impregnated elastomer particles may be performed in conjunction with each other while the photoconductor drum 14 rotates one revolution.

In this case, it is preferable that a mechanism for dispersing the toner and the oil-impregnated elastomer particles Po in the axial direction of the photoconductor drum 14 is provided on the upstream side of the cleaning blade 64.

Furthermore, in the image forming process, the calibration mode may be executed regularly or irregularly, irrespective of the area coverage. As an example of regular execution, the calibration mode may be executed every time that a predetermined pieces of recording paper P are processed. By regular or irregular execution of the calibration mode, the amount of oil-impregnated elastomer particles Po to be supplied to the photoconductor drum 14 may be prevented from being smaller than an allowable lower limit, and may be maintained within the allowable range.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a developing unit that includes a developing part which stores oil-impregnated particles on an image carrier which is electrically charged to a polarity that is opposite a polarity of a developer which is electrically charged to a positive polarity or a negative polarity, a charging device electrically charging the image carrier to a first potential which has a potential difference from a developing potential in a same polarity direction as the polarity of the developer based on the potential of the developing part, then forming, based on image information, an electrostatic latent image at a second potential which has a potential difference from the developing potential in a polarity direction that is opposite the polarity of the developer based on the potential of the developing part, and thus transferring the developer to the electrostatic latent image to develop the electrostatic latent image; and a supply amount increasing unit that increases an amount of supply of the oil-impregnated particles to the image carrier by electrically charging the image carrier to a third potential which has a potential difference from the developing potential greater than the first potential, while a developing operation is not being performed by the developing unit.

2. The image forming apparatus according to claim 1, wherein when a proportion of an actually developed region in a region of the image carrier where development is able to be performed exceeds a predetermined threshold in the developing operation, the supply amount increasing unit increases the amount of supply of the oil-impregnated particles to the image carrier during a period up to a next developing operation.

3. The image forming apparatus according to claim 1, wherein the supply amount increasing unit increases the amount of supply of the oil-impregnated particles to the image carrier every time that a predetermined number of developing operations are performed.

4. The image forming apparatus according to claim 1, further comprising:

a blade that scrapes the developer which remains after an image developed on the image carrier is transferred to a transfer object, in accordance with the developing operation by the developing unit.

5. An image forming method comprising:

supplying oil-impregnated particles to an image carrier, having a first region and a second region, and developing an electrostatic latent image by a developer on the image carrier which is electrically charged to a polarity that is opposite a polarity of the developer which is electrically charged to a positive polarity or a negative polarity, based on a potential difference between a developing part and the image carrier; and increasing an amount of supply of the oil-impregnated particles to the image carrier by adjusting the potential of the image carrier, while a developing operation is not being performed, wherein the amount of supply of the oil-impregnated particles is increased to the image carrier by electrically charging the image carrier to a potential which has a potential difference from the developing potential greater than the first potential, while a developing operation is not being performed.

6. An image forming method comprising:

storing oil-impregnated particles on an image carrier, having a first region and a second region, which is electrically charged to a polarity that is opposite a polarity of a developer which is electrically charged to a positive polarity or a negative polarity, electrically charging the image carrier to a first potential which has a potential difference from a developing potential in a same polarity direction as the polarity of the developer based on the potential of a developing part, then forming, based on image information, an electrostatic latent image at a second potential which has a potential difference from the developing potential in a polarity direction that is opposite the polarity of the developer based on the potential of the developing part, and thus transferring the developer to the electrostatic latent image to develop the electrostatic latent image; and increasing an amount of supply of the oil-impregnated particles to the image carrier by electrically charging the image carrier to a third potential which has a potential difference from the developing potential greater than the first potential, while a developing operation is not being performed.

* * * * *